US007923708B2

(12) United States Patent
Oyaizu

(10) Patent No.: US 7,923,708 B2
(45) Date of Patent: Apr. 12, 2011

(54) RADIATION SHIELDING SHEET

(75) Inventor: Eiji Oyaizu, Yokohama (JP)

(73) Assignees: Kabushiki Kaisha Toshiba, Tokyo (JP); Toshiba Materials Co., Ltd., Yokohama-shi (JP)

( * ) Notice: Subject to any disclaimer, the term of this patent is extended or adjusted under 35 U.S.C. 154(b) by 700 days.

(21) Appl. No.: 11/816,778

(22) PCT Filed: Feb. 16, 2006

(86) PCT No.: PCT/JP2006/302702
§ 371 (c)(1), (2), (4) Date: Aug. 21, 2007

(87) PCT Pub. No.: WO2006/090629
PCT Pub. Date: Aug. 31, 2006

(65) Prior Publication Data

US 2009/0078891 A1 Mar. 26, 2009

(30) Foreign Application Priority Data

Feb. 23, 2005 (JP) ..... 2005-047199

(51) Int. Cl.
*G21F 5/00* (2006.01)

(52) U.S. Cl. ..... 250/515.1; 250/505.1; 250/516.1; 250/519.1

(58) Field of Classification Search ..... 250/505.1–519.1
See application file for complete search history.

(56) References Cited

U.S. PATENT DOCUMENTS

| | | | | |
|---|---|---|---|---|
| 6,344,505 | B1 * | 2/2002 | Valentine et al. | 524/91 |
| 6,465,146 | B1 * | 10/2002 | Kawamura | 430/138 |
| 6,465,799 | B1 * | 10/2002 | Kimble et al. | 250/504 R |
| 7,238,418 | B2 * | 7/2007 | Fujita | 428/328 |
| 7,361,378 | B1 * | 4/2008 | Funabashi | 427/65 |
| 7,476,889 | B2 * | 1/2009 | DeMeo et al. | 250/516.1 |
| 2004/0019143 | A1 * | 1/2004 | Koloski et al. | 524/434 |
| 2004/0071957 | A1 * | 4/2004 | Fujita | 428/328 |
| 2004/0124374 | A1 * | 7/2004 | Joseph | 250/507.1 |
| 2004/0219586 | A1 * | 11/2004 | Kuruma et al. | 435/6 |
| 2005/0018817 | A1 * | 1/2005 | Oettinger et al. | 378/203 |
| 2005/0211930 | A1 * | 9/2005 | DeMeo et al. | 250/516.1 |
| 2006/0099420 | A1 * | 5/2006 | Bujard | 428/403 |
| 2006/0251203 | A1 * | 11/2006 | Okamura et al. | 376/287 |

FOREIGN PATENT DOCUMENTS

| | | | |
|---|---|---|---|
| JP | 11 337681 | | 12/1999 |
| JP | 11337681 | A * | 12/1999 |
| JP | 2001 83288 | | 3/2001 |
| JP | 2004 531730 | | 10/2004 |
| JP | 2005 24435 | | 1/2005 |

* cited by examiner

*Primary Examiner* — Bernard E Souw
*Assistant Examiner* — Andrew Smyth
(74) *Attorney, Agent, or Firm* — Oblon, Spivak, McClelland, Maier & Neustadt, L.L.P.

(57) ABSTRACT

A radiation shielding sheet formed by filling a shielding material into an organic polymer material. The shielding material is an oxide powder containing at least one element selected from the group consisting of lanthanum (La), cerium (Ce), praseodymium (Pr), neodymium (Nd), samarium (Sm), europium (Eu) and gadolinium (Gd). The oxide powder has an average grain size of 1 to 20 μm, and a volumetric ratio of the shielding material filled in the radiation shielding sheet is 40 to 80 vol. %.

13 Claims, 1 Drawing Sheet

RADIATION SHIELDING SHEET

TECHNICAL FIELD

The present invention relates to a radiation shielding sheet which is used for the purpose of shielding a radiation (radioactive rays) in various technical fields such as radiation shielding in a nuclear power plant, inspection apparatus using a radiation, radiation shielding in a radiation apparatus for medical application, X-ray room, X-ray medical examination vehicle, X-ray protective clothes or the like. More particularly, the present invention relates to a radiation shielding sheet which is free from any environmental problems and safety problems for a human body, and having a highly radiation shielding performance and excellent economical efficiency.

BACKGROUND ART

Generally, in a technical field to which a radiation shielding technique is applied, particularly in a case where a radiation therapy targeting at a human body and a measuring operation are performed, countermeasure for lowering an absolute amount of the harmful radiation has been essentially demanded. In order to reply to this demand, the following countermeasures have been devised. Namely, the radioactive rays are effectively irradiated to only a target portion, while the irradiation of the radioactive ray is not performed to portions other than the target portion, and the radiation time is shortened as short as possible.

However, it is essentially difficult to limitedly irradiate the radiation only to the target portion which is an objective portion to be examined by means of the radiation. Therefore, there has been actually taken a countermeasure such that the portions other than the target portion to be examined are covered with a shielding material for shielding the radiation, whereby an object (human body) to be examined is protected from being exposed to the radiation.

Further, also in case of an X-ray room or an X-ray medical examination car (vehicle) with which an X-ray generating apparatus is equipped, for the purpose of preventing the X-ray from leaking from a wall surface of the X-ray room to outside of the room or preventing the X-ray from leaking to outside of the car, there has been taken a countermeasure such that the radiation shielding material is attached to the wall surfaces of the X-ray room or the like. Furthermore, when an X-ray photograph is taken, a doctor and a patient would wear X-ray protection clothes and they engaged in the X-ray examining operation so as to avoid to be exposed to unnecessary X-ray radiation.

As a material for shielding the X-ray which is one kind of the above radiations (radioactive rays), as has been prescribed in Japanese Industrial Standard (JIS Z4806, Z4801), there has been conventionally used mainly a lead (Pb) or a composite material containing the lead. However, a lead component is harmful when the lead component is absorbed into a human body, and the lead component shall demand a lot of attentions in handling or disposal thereof. Namely, the handling of the lead component is required to comply with strict regulations specified in Lead Poisoning Prevention Rules. While, in case of the disposal of the lead component, it is necessary to perform a treatment for securing that elusion or leaking of the lead component to an outer world is securely blocked.

In recent years, in view of the above problems, as disclosed in a patent document 1 (Japanese Patent Publication: No. 2001-83288) and a patent document 2 (Japanese Patent Publication: No. 2002-365393), there have been proposed a countermeasure in which tungsten (W), tin (Sn), antimony (Sb), bithmus (Bi) and compounds thereof are used as the radiation shielding materials taking the place of the harmful lead.

Further, as for the X-ray protection clothes requiring a flexibility for matching an outer shape of the object to be examined, there has been generally used a material which is formed by blending the above materials with resin or rubber to prepare a material mixture, followed by molding the material mixture. In another case where a radiation having a relatively low intensity is used, an acrylic plate or the like are used as a simple countermeasure. On the other hand, in a case where a radiation having a relatively high intensity is used, there has been generally used a plate-shaped radiation shielding material composed of tungsten (W) or the like having a high shielding capability.

However, although the tungsten (W) plate has a high capacity of shielding the radiation, tungsten is a high cost material taking the place of lead (Pb). Further, bithmus (Bi) also has a high radiation-shielding capacity equivalent to that of Pb. However, bithmus is also a relatively high cost material. On the other hand, both antimony (Sb) and tin (Sn) are insufficient in the radiation shielding capacity, so that a thickness of a radiation-shielding sheet becomes thick in order to secure a sufficient shielding capacity, thus resulting in a disadvantage in lacking of mobility during handling the shielding sheet. In addition, it has been suggested that antimony (Sb) has toxic consequences similar to arsenic. In view of the above circumstances, there have been demanded a radiation shielding sheet which is free from an environmental problem, and has a uniform and high radiation shielding capacity and an excellence in economical efficiency.

Patent Document 1: Japanese Patent Application Laid-open Publication No. 2001-83288

Patent Document 2: Japanese Patent Application Laid-open Publication No. 2002-365393

However, in the conventional radiation shielding materials, since the lead or the composite material containing lead had been used as the material for constituting the radiation shielding materials, there had been posed the following problems as described hereinbefore. Namely, such material was harmful when the material was absorbed in a human body, and special attentions must be paid at a time of handling or disposal of the shielding material, thus being lack in safety of the radiation shielding materials.

As a radiation shielding material taking the place of lead, there has been proposed that tungsten (W), tin (Sn), antimony (Sb), bithmus (Bi) and compounds thereof should be used. However, the materials such as tungsten, bithmus and compounds thereof were high cost materials as a material in place of lead, so that a manufacturing cost of the shielding material is disadvantageously increased. In addition, there is arisen a fatal problem such that tungsten, bithmus and compounds thereof were insufficient in shielding capacity in comparison with those of the conventional materials.

The present invention had been achieved to solve the aforementioned problems caused in the conventional prior arts, and an object of the present invention is to provide a radiation-shielding sheet which is free from any environmental problems and safety problems for a human body, and having a highly radiation shielding performance and excellent economical efficiency.

DISCLOSURE OF THE INVENTION

In order to achieve the aforementioned object, the present invention provides a radiation shielding sheet formed by filling a shielding material into an organic polymer material, wherein the shielding material is an oxide powder containing at least one element selected from the group consisting of lanthanum (La), cerium (Ce), praseodymium (Pr), neodymium (Nd), samarium (Sm), europium (Eu) and gadolinium (Gd), the oxide powder has an average grain size of 1 to 20 μm, and a volumetric ratio of the shielding material filled in the radiation shielding sheet is 40 to 80 vol. %.

As the organic polymer material to be a base material for constituting the radiation shielding sheet according to the present invention, a kind of the materials is not particularly limited but materials such as rubber, thermoplastic elastomer, polymer resin or the like are suitably used. As the rubber material, natural rubber or synthetic rubber can be used, and an additive agent such as sulfur, carbon black, anti-aging agent or the like can be added to the rubber materials.

As the resin material, thermoplastic resins such as polyvinyl resin, polyamide resin, polyolefin resin, ABS resin, EVA resin or the like, or thermo-setting resins such as epoxy resin, phenol resin or the like can be preferably used. As an additive agent to be added to the aforementioned resins, it is possible to add a required amount of coupling agent, coloring agent, anti-static agent, plasticizer, stabilizing agent, pigment or the like. It is preferable to use organic polymer material excluding rubbers and chlorine-containing resin, because the rubbers are liable to cause an aging (degrading) phenomenon while the chlorine-containing resin would be an origin of generating harmful dioxin. As a result, it is particularly preferable to use polyurethane resin that is excellent in both strength and elasticity.

The oxide powder of at least one rare earth element selected from the group consisting of lanthanum (La), cerium (Ce), praseodymium (Pr), neodymium (Nd), samarium (Sm), europium (Eu) and gadolinium (Gd) has an excellent radiation-shielding performance (capability), and a material cost of the oxide is low in price in comparison with other conventional metal materials such as tungsten or the like or other shielding materials, thus being excellent in economical efficiency. Particularly, when considering all the various factors such as shielding capacity and the economical efficiency together, the oxide powders of lanthanum, cerium, praseodymium, neodymium, samarium and europium are most effective, so that the radiation shielding sheet is required to contain at least one of the above rare earth element.

The oxide powder of the above rare earth element has a relatively low specific gravity in comparison with that of tungsten or the like, so that there may be a tendency that a filling ratio of the oxide powder with respect to an entire radiation-shielding sheet is liable to be lowered. As a result, the radiation shielding capacity of the shielding sheet is lowered. Therefore, the filling ratio of the oxide powder as the shielding material with respect to the entire radiation-shielding sheet is specified to a range of 40 to 80 vol. %.

In this connection, the filling ratio of the shielding material is indicated as a volumetric ratio of the shielding material with respect to a volume (100 vol. %) of the entire radiation-shielding sheet, wherein the entire volume (100 vol. %) consists of: a volume of the shielding material after completion of drying operation; a volume of the organic polymer material; and a volume of void space formed in the shielding sheet.

When the filling ratio of the shielding material is less than 40 vol. %, the radiation shielding capacity of the shielding sheet becomes insufficient. On the other hand, when the filling ratio becomes excessively large so as to exceed 80 vol. %, a strength for retaining the shielding material of the shielding sheet becomes insufficient, thereby to lower a structural strength of the radiation shielding sheet.

Aforementioned radiation shielding materials are used in a form of powder or pellet. In this regard, it is preferable that a content ratio (powder content ratio) of an entire shielding material in a form of powder with respect to an entire weight of the shielding sheet is set to within a range of 70 mass % or more and 97 mass % or less.

When the powder content ratio is less than 70 mass %, the radiation shielding capacity is lowered, thus being unsuitable for a practical use. In contrast, when the powder content ratio exceeds 97 mass %, powder grains are not completely incorporated into the shielding sheet, so that the structural strength of the entire radiation shielding sheet cannot be retained.

An average grain size of the oxide powder constituting the radiation shielding material is set to a range of 1 to 20 μm from various viewpoints of: dispersibility of the oxide powder for the shielding sheet into the resin; retention of flexibility of the shielding sheet; and a reliability against bending operation, or the like. The above average grain size of the oxide powder is measured by means of a powder grain size measuring apparatus (F.s.s.s.: Fisher Sub Sieve Sizer) which is prescribed in Japanese Industrial Standard (JIS H 2116).

When the average grain size of the oxide powder constituting the radiation shielding material is set to within the aforementioned range, the powder grains become easily incorporated into the resin, so that it becomes easy to retain the flexibility of the entire material. While the problem of crack-formation during the operation of the shielding material can be eliminated, so that durability and reliability of the radiation shielding sheet can be further improved. In addition, the filling ratio of the shielding material is increased, so that the capacity of shielding the radiation using the radiation shielding sheet can be improved.

According to the radiation shielding material having the structure as described above, the oxide powder of rare earth element having a safety, a low cost and a high radiation shielding capacity is filled into the organic polymer material, the average grain size of the oxide powder is controlled to be within a predetermined range, and the filling ratio of the shielding material is adjusted to fall within a predetermined range, so that there can be obtained the radiation shielding sheet which is free from any environmental problems and safety problems for a human body, and having a highly radiation shielding performance and excellent economical efficiency.

In order to achieve the aforementioned object, the present invention provides a radiation shielding sheet comprising: an organic polymer material; and a shielding material contained in the organic polymer material, wherein the shielding material is an oxide powder of a single substance of metal element or metal compound, and having a composition containing lanthanum and cerium.

Among the above rare earth elements, when there is used a shielding material comprising an oxide powder of a single substance of metal element or metal compound, and having a composition containing lanthanum (La) and cerium (Ce), the radiation shielding effect can be exhibited more remarkably, and the material cost is low, thus being excellent in economical efficiency. As the above compound powder, oxide, composite oxide, nitride, boride, or the like of lanthanum and cerium can be suitably used.

The metal composition containing lanthanum (La) and cerium (Ce) may further contain neodymium (Nd). Furthermore, the metal composition may further contain other rare earth metals. Even if the material compositions are changed to a different composition as described above, it has been confirmed that the radiation can be also effectively shielded.

Further, in the above radiation shielding sheet, it is preferable that the metal compound powder has a composition containing 10 to 40 mass % of lanthanum (La) oxide and 30 to 60 mass % of cerium (Ce) oxide.

Among the oxides of the above rare earth elements, when there is particularly used the metal compound having a composition containing lanthanum (La) oxide and cerium (Ce) oxide, the radiation shielding effect can be exhibited further more remarkably, and the material cost is low, thus being excellent in economical efficiency.

Furthermore, in also the radiation shielding sheet using the shielding material containing the lanthanum component and the cerium component, it is preferable that the volumetric ratio (filling ratio) of the shielding material to be filled in the radiation shielding sheet is 40 to 80 vol. %. That is, in order to maintain both the radiation-shielding capacity and the structural strength of the shielding sheet to be high, the volumetric ratio (filling ratio) of the shielding material should be set to within a range of 40 to 80 vol. %.

Furthermore, in the above radiation shielding sheet, it is also preferable to adopt the following feature. That is, when assuming that an average grain size of the shielding material existing in a structure of the radiation shielding sheet is A μm, a number of the shielding material grains existing within a straight line segment range having a length of 50 μm is 30/A or more when the straight line segment range is arbitrarily drawn on a surface of the structure of the radiation shielding sheet.

The number of the shielding material grains existing within a straight line segment range having a length of 50 μm, which is arbitrarily drawn on a surface of the structure of the radiation shielding sheet, is suitable for evaluating a dispersion state of the shielding material grains. Namely, the number of the shielding material grains becomes an index for determining a degree of the shielding effect against the irradiated radiation.

When the number of the shielding material grains existing within the straight line segment range having the length of 50 μm arbitrarily drawn on the radiation shielding sheet is less than 30/A, an amount of radiation leaking through void portions formed between the grains is disadvantageously increased, thus resulting in that a shielding capacity cannot be obtained at some portions of the radiation shielding sheet.

A method of counting the number of the shielding material grains existing within the straight line segment range having a predetermined length drawn on the radiation shielding sheet is performed as shown, for example, in FIGS. 2 and 3. That is, a macro (enlarged) photograph of a surface structure or sectional structure of the shielding sheet is taken at an arbitral portion. Then, a straight line having a length of 50 μm is arbitrarily drawn on the radiation shielding sheet. In this state, the number of the shielding material grains existing on the straight line is counted.

As to the above macro (enlarged) photograph, a magnification of 2000 or higher is preferable. According to this macro photograph with the high magnification, when the surface structure or the sectional structure of the shielding sheet is observed, a dispersion of accuracy in determining whether a grain contacts on the straight line or not can be minimized, so that it becomes possible to count the number of the grains with a high accuracy.

Further, when the length of the straight line segment is set to about 50 μm at a time of counting the number of the shielding material grains, a dispersion in the counted numbers of the shielding material grains for each measured portions is small. Therefore, the length of the straight line is set to 50 μm in the present invention. As to portions at which the number of grains is measured, the measuring operation is performed at totally four portions including two portions selected from the surface structure and two portions selected from the sectional structure of the radiation shielding sheet, and the number is expressed as an average value obtained by averaging the respective measured values for the four portions.

In this regard, at the time of counting the number of the shielding material grains, the shielding material grain existing on the straight line so that a part of the grain is included on the line shall be counted. A center portion of the shielding material grain is not always necessary to be disposed on the straight line. That is, if an edge portion of the shielding material grain touches onto the straight line, such shielding material grain shall be included in the number of the grains as specified above.

As shown in FIG. 2, when the number of the shielding material grains existing within the straight line segment range having a length of 50 μm drawn on the radiation shielding sheet is large and the shielding material grains are densely dispersed in an entire straight line segment range L having the length of 50 μm, the irradiated radiation is effectively shielded by the shielding material, so that a high radiation shielding effect can be obtained.

On the other hand, as shown in FIG. 3, when the number of the shielding material grains existing within the predetermined straight line segment L is small and the shielding material grains are non-densely dispersed even in a part of the straight line segment range L, the amount of radiation leaking through void portions formed between the grains is disadvantageously increased, thus resulting in that a shielding capacity cannot be obtained at some portions of the radiation shielding sheet.

Further, in the above radiation shielding sheet, it is preferable that the organic polymer material is further mixed with at least one powder selected from the group consisting of tungsten, bithmus, tin and compounds thereof.

All of the above tungsten, bithmus, tin and compounds thereof is a material having a high shielding performance for shielding the radiation. Therefore, when the above materials are appropriately mixed to the shielding material, the radiation shielding capacity of the shielding sheet can be further enhanced.

However, each of the above materials is expensive in material cost. Therefore, if the above material is used to be mixed, a mixing ratio of the material should be set to within a range without impairing the economical efficiency. Concretely, it is preferable that the mixing ratio of the above material should be set to within a range of 30 weight parts or less. Further, tin (Sn) may be also mixed to the shielding material at an amount without impairing the shielding capacity. Concretely, tin may be added at an amount within a range of 40 weight parts or less.

In this regard, the term "weight part" indicating a mixing ratio of the above shielding material means a weight ratio of the above shielding material with respect to a total amount (100 weight parts) of a weight of the shielding material prior to a drying operation and a weight of the organic polymer material.

When using the above shielding materials, there can be provided a radiation shielding sheet which is excellent in economical efficiency and hygienic safety, and capable of obtaining a high radiation shielding capacity, and is almost free from adverse effects on environment and human body in comparison with the conventional radiation shielding sheets using lead or lead alloy.

The radiation shielding sheet of the present invention is formed in such a manner that the shielding material powder having a sufficiently high radiation absorbing factor is uniformly dispersed into in the organic polymer material, so that the resultant radiation shielding sheet has not only a sufficient radiation shielding capacity but also has a flexibility.

Further, in order to protect one side surface or both front side and rear side surfaces of the radiation shielding sheet, or in order to improve a structural strength including a tensile strength of the radiation shielding sheet, it is also possible to configure the radiation shielding sheet by integrally providing an organic polymer film layer onto the surface of the shielding sheet. Furthermore, in order to increase the shielding capacity, it is also possible to configure a radiation shielding sheet so as to have a laminar structure in which a plurality of thin shielding sheets are piled up and integrally formed into a laminated sheet.

Thus prepared radiation shielding sheet can exhibit an excellent radiation shielding effect when the radiation shielding sheet is used as a material for constituting a wall of a X-ray room.

According to the radiation shielding sheet of the present invention, the oxide powder of rare earth element having a safety, a low cost and a high radiation shielding capacity is filled into the organic polymer material, the average grain size of the oxide powder is controlled to be within a predetermined range, and the filling ratio of the shielding material is adjusted to fall within a predetermined range, so that there can be obtained the radiation shielding sheet which is free from any environmental problems and safety problems for a human body, and having a highly radiation shielding performance and excellent economical efficiency.

BEST MODE FOR CARRYING OUT THE INVENTION

An embodiment of a radiation shielding sheet according to the present invention will be described hereunder with reference to the accompanying drawings together with the following Examples and Comparative Examples.

Example 1

90 weight parts of cerium oxide ($CeO_2$) powder having an average grain size of 5 μm as a shielding material, 9 weight parts of polyurethane resin as an organic polymer resin, and 1 weight part of plasticizer were weighted to prepare a mixed material. Then, the mixed material was mixed and diluted with methyl ethyl ketone/toluene mixed solution (volumetric mixing ratio: 50/50) as a solvent, thereby to prepare a mixed solution.

With respect to this mixed solution, a milling treatment using a magnetic pot was performed for two hours thereby to prepare a uniform coating liquid containing refined components. This coating liquid was uniformly coated onto a substrate by means of a knife coater, followed by drying the coated layer, thereby to manufacture a radiation shielding sheet having a thickness of 1 mm according to Example 1.

Example 2

The same procedure for obtaining a radiation shielding sheet as in Example 1 was repeated except that cerium oxide ($CeO_2$) powder having an average grain size of 1 μm was used as the radiation shielding material, thereby to manufacture a radiation shielding sheet according to Example 2.

Example 3

The same procedure for obtaining a radiation shielding sheet as in Example 1 was repeated except that cerium oxide ($CeO_2$) powder having an average grain size of 5 μm was used as the radiation shielding material and the milling treatment was performed for a short time of 0.5 hour, thereby to manufacture a radiation shielding sheet according to Example 3.

Example 4

The same procedure for obtaining a radiation shielding sheet as in Example 1 was repeated except that lanthanum oxide ($La_2O_3$) powder having an average grain size of 5 μm was used as the radiation shielding material, thereby to manufacture a radiation shielding sheet according to Example 4.

Example 5

The same procedure for obtaining a radiation shielding sheet as in Example 1 was repeated except that praseodymium oxide ($Pr_2O_3$) powder having an average grain size of 10 μm was used as the radiation shielding material, thereby to manufacture a radiation shielding sheet according to Example 5.

Example 6

The same procedure for obtaining a radiation shielding sheet as in Example 1 was repeated except that neodymium oxide ($Nd_2O_3$) powder having an average grain size of 10 μm was used as the radiation shielding material, thereby to manufacture a radiation shielding sheet according to Example 6.

Example 7

The same procedure for obtaining a radiation shielding sheet as in Example 1 was repeated except that samarium oxide ($Sm_2O_3$) powder having an average grain size of 5 μm was used as the radiation shielding material, thereby to manufacture a radiation shielding sheet according to Example 7.

Example 8

The same procedure for obtaining a radiation shielding sheet as in Example 1 was repeated except that europium oxide ($Eu_2O_3$) powder having an average grain size of 5 μm was used as the radiation shielding material, thereby to manufacture a radiation shielding sheet according to Example 8.

Example 9

The same procedure for obtaining a radiation shielding sheet as in Example 1 was repeated except that gadolinium oxide ($Gd_2O_3$) powder having an average grain size of 20 μl was used as the radiation shielding material, thereby to manufacture a radiation shielding sheet according to Example 9.

Example 10

The same procedure for obtaining a radiation shielding sheet as in Example 1 was repeated except that an oxide powder mixture comprising: 45 weight parts of cerium oxide powder having an average grain size of 5 μm; 30 weight parts of lanthanum oxide powder, and 15 weight parts of other rare earth oxide powder; was used as the radiation shielding material, thereby to manufacture a radiation shielding sheet according to Example 10.

Example 11

The same procedure for obtaining a radiation shielding sheet as in Example 1 was repeated except that an oxide powder mixture comprising: 60 weight parts of cerium oxide powder having an average grain size of 5 μl; 10 weight parts of lanthanum oxide powder, and 20 weight parts of other rare earth oxide powder; was used as the radiation shielding material, thereby to manufacture a radiation shielding sheet according to Example 11.

Example 12

The same procedure for obtaining a radiation shielding sheet as in Example 1 was repeated except that a powder mixture comprising: 80 weight parts of cerium oxide powder having an average grain size of 5 μm; and 10 weight parts of tungsten (W) powder; was used as the radiation shielding material, thereby to manufacture a radiation shielding sheet according to Example 12.

Example 13

The same procedure for obtaining a radiation shielding sheet as in Example 1 was repeated except that a powder mixture comprising: 70 weight parts of cerium oxide powder having an average grain size of 5 μm; and 20 weight parts of bithmus (Bi) powder having an average grain size of 6 μm; was used as the radiation shielding material, thereby to manufacture a radiation shielding sheet according to Example 13.

Example 14

The same procedure for obtaining a radiation shielding sheet as in Example 1 was repeated except that a powder mixture comprising: 50 weight parts of cerium oxide powder having an average grain size of 5 μm; and 40 weight parts of tin (Sn) powder having an average grain size of 25 μm; was used as the radiation shielding material, thereby to manufacture a radiation shielding sheet according to Example 14.

Example 15

The same procedure for obtaining a radiation shielding sheet as in Example 1 was repeated except that cerium oxide powder having an average grain size of 5 μm was used as the radiation shielding material, thereby to manufacture a radiation shielding sheet according to Example 15.

Example 16

The same procedure for obtaining a radiation shielding sheet as in Example 1 was repeated except that cerium metal powder having an average grain size of 5 μm was used as the radiation shielding material, thereby to manufacture a radiation shielding sheet according to Example 16.

Comparative Example 1

On the other hand, there was prepared a radiation shielding sheet according to Comparative Example 1 that was composed of a lead plate having a thickness of 1 mm.

Comparative Example 2

The same procedure for obtaining a radiation shielding sheet as in Example 1 was repeated except that 90 weight parts of tungsten (W) metal powder having an average grain size of 6 μm was used as the radiation shielding material, thereby to manufacture a radiation shielding sheet according to Comparative Example 2.

Comparative Example 3

The same procedure for obtaining a radiation shielding sheet as in Example 1 was repeated except that 90 weight parts of tin (Sn) metal powder having an average grain size of 25 μm was used as the radiation shielding material, thereby to manufacture a radiation shielding sheet according to Comparative Example 3.

Comparative Example 4

The same procedure for obtaining a radiation shielding sheet as in Example 1 was repeated except that 90 weight parts of cerium (Ce) oxide powder having an average grain size of 5 μm was used as the radiation shielding material and the milling treatment was not performed, thereby to manufacture a radiation shielding sheet according to Comparative Example 4.

Comparative Example 5

The same procedure for obtaining a radiation shielding sheet as in Example 1 was repeated except that the cerium (Ce) oxide powder having an average grain size of 5 μm was used as the radiation shielding material and the coated layer was quickly dried under a condition where a drying temperature was arisen, thereby to manufacture a radiation shielding sheet according to Comparative Example 5 in which the number of the shielding material grains existing on the straight line segment having a unit length drawn on the structure of the sheet was less than a preferable range.

In this connection, the above drying conditions ware set to as follows. Namely, the drying temperature was set to a high temperature so that the resin particles were not easily combined to each other after the solvent in a state of being mixed with resin was vaporized and the filling ratio of the shielding material was lowered. As a result, the number of the shielding material grains having an average grain size of A μm and existing within a straight line segment having a length of 50 μm drawn on the sheet structure was three which is less than 30/A.

Each of thus prepared radiation shielding sheets 1 according to the respective Examples has a structure shown in FIG. 1 in which the shielding material powder 3 is uniformly dispersed in the polyurethane resin as an organic polymer material. In order to protect one side surface of the radiation shielding sheet 1 or in order to improve the structural strength including a tensile strength of the radiation shielding sheet 1, it is also possible to configure the shielding sheet by integrally providing with an organic polymer film layer 4 as a protective/reinforcing layer.

In order to evaluate the radiation shielding capacity of thus prepared radiation shielding sheets according to Examples and Comparative Examples, the following X-ray transmission test was performed. That is, the evaluation for measuring the radiation shielding capacity was performed in accordance with a method prescribed in Japanese Industrial Standard (JIS Z4501) in which an X-ray generator (X-ray tube voltage: 100 kV) was used, and an amount of X-ray transmitted through the respective radiation shielding sheets of Examples or the like was measured. Then, the amount of the transmitted X-ray was compared with the amount of X-ray transmitted through the radiation shielding sheet composed of lead (Pb) according to Comparative Example 1, thereby to measure a lead equivalent of the respective shielding sheets. In this regard, a measuring area for determining the lead equivalent was set to within a circle having a diameter of 20 mm.

With respect to the respective radiation shielding sheets, total four portions including two portions selected from the surface structure and two portions selected from the sectional structure of the radiation shielding sheet were arbitrarily selected as measuring portions. An enlarged photograph of the respective measuring portions was taken at a magnification of 2000. Onto the photographic image, a straight line segment range having a length of 50 μm was set. The number of the shielding material grains included by the straight line segment range was counted with respect to each of the measuring portions. The numbers counted at each measuring portions were averaged.

Further, a volumetric proportion of the shielding material with respect to an entire volume of the respective radiation shielding sheets was measured as a filling ratio. Furthermore, an environmental evaluation was performed with respect to each radiation shielding sheet in the following manner. Namely, a reference symbol (X) was marked in a case where the constitutional material of the radiation shielding sheet was designated as substance to pollute environment as prescribed in law and regulation (European Command of RoHS: Restricting the use of Hazardous Substances). On the other hand, a reference symbol (○) was marked in a case where the constitutional material sheet was not designated as substance to pollute environment by the laws and regulations. The above results of measuring and evaluation are shown in Table 1 hereunder.

TABLE 1

| | Shielding Material | | | | | Radiation Shielding Sheet | | | |
|---|---|---|---|---|---|---|---|---|---|
| | | | Average Grain | Organic Polymer Material etc. | | Number of Shielding Material Grains | Filling | Lead | |
| Sample No. | Kind | Weight Parts | Size [μm] | Kind | Weight Parts | Existing on Straight Line Segment of 50 μm | Ratio (vol. %) | Equivalent (mmPb) | Environmental Evaluation |
| Example 1 | $CeO_2$ Powder | 90 | 5 | Polyurethane Resin | 10 | 9 | 72 | 0.45 | ○ |
| Example 2 | $CeO_2$ Powder | 90 | 1 | Polyurethane Resin | 10 | 46 | 62 | 0.43 | ○ |
| Example 3 | $CeO_2$ Powder | 90 | 5 | Polyurethane Resin | 10 | 8 | 40 | 0.35 | ○ |
| Example 4 | $La_2O_3$ Powder | 90 | 5 | Polyurethane Resin | 10 | 8 | 46 | 0.35 | ○ |
| Example 5 | $Pr_2O_3$ Powder | 90 | 10 | Polyurethane Resin | 10 | 10 | 51 | 0.45 | ○ |
| Example 6 | $Nd_2O_3$ Powder | 90 | 10 | Polyurethane Resin | 10 | 7 | 55 | 0.45 | ○ |
| Example 7 | $Sm_2O_3$ Powder | 90 | 5 | Polyurethane Resin | 10 | 12 | 59 | 0.46 | ○ |
| Example 8 | $Eu_2O_3$ Powder | 90 | 5 | Polyurethane Resin | 10 | 10 | 64 | 0.48 | ○ |
| Example 9 | $Gd_2O_3$ Powder | 90 | 20 | Polyurethane Resin | 10 | 5 | 60 | 0.50 | ○ |
| Example 10 | $CeO_2$ Powder/$La_2O_3$ Powder/$Nd_2O_3$ Powder | 45/30/15 | 5 | Polyurethane Resin | 10 | 7 | 50 | 0.40 | ○ |
| Example 11 | $CeO_2$ Powder/$La_2O_3$ Powder/$Nd_2O_3$ Powder | 60/10/20 | 5 | Polyurethane Resin | 10 | 7 | 50 | 0.43 | ○ |
| Example 12 | $CeO_2$ Powder/W Powder | 80/10 | 5/6 | Polyurethane Resin | 10 | 9 | 65 | 0.55 | ○ |
| Example 13 | $CeO_2$ Powder/Bi Powder | 60/30 | 5/6 | Polyurethane Resin | 10 | 9 | 62 | 0.50 | ○ |
| Example 14 | $CeO_2$ Powder/Sn Powder | 50/40 | 5/25 | Polyurethane Resin | 10 | 7 | 55 | 0.40 | ○ |
| Example 15 | Ce Powder | 90 | 5 | Polyurethane Resin | 10 | 10 | 69 | 0.47 | ○ |
| Example 16 | La Powder | 90 | 5 | Polyurethane Resin | 10 | 9 | 52 | 0.38 | ○ |
| Comparative Example 1 | Pb Plate | 100 | — | — | — | — | 100 | 1.00 | x |
| Comparative Example 2 | W Powder | 90 | 6 | Polyurethane Resin | 10 | 10 | 70 | 0.85 | ○ |
| Comparative Example 3 | Sn Powder | 90 | 25 | Polyurethane Resin | 10 | 3 | 67 | 0.30 | ○ |
| Comparative Example 4 | $CeO_2$ Powder | 90 | 5 | Polyurethane Resin | 10 | 9 | 36 | 0.25 | ○ |
| Comparative Example 5 | $CeO_2$ Powder | 90 | 5 | Polyurethane Resin | 10 | 3 | 41 | 0.30 | ○ |

As is clear from the results shown in above Table 1, according to the radiation shielding sheets of the respective Examples in which the oxide powder of rare earth element having a safety, a low cost and a high radiation shielding capacity is filled into the organic polymer material, the average grain size of the oxide powder is controlled to be within a predetermined range, and the filling ratio of the shielding material is adjusted to fall within a predetermined range. Therefore, it was confirmed that there can be obtained the radiation shielding sheet which is free from any environmental problems and safety problems for a human body, and having a highly radiation shielding performance and excellent economical efficiency.

In particular, when assuming that an average grain size of the shielding material grains existing in the structure of the radiation shielding sheet was A μm, according to the radiation shielding sheets of the respective Examples in which the grain size and the filling ratio of the shielding material were controlled so that the number of the shielding material grains existing within the straight line segment range having a length of 50 μm was 30/A or more when the straight line segment range was arbitrarily drawn on the above sheet structure, as shown in FIG. 2, the number of the shielding material grains 3 existing within the straight line segment range having a length L (50 μm) which was arbitrarily drawn on the radiation shielding sheet 1 was large, and the shielding material grains 3 were densely dispersed in entire straight line segment range. Therefore, the irradiated radiation was effectively shielded by the shielding material grains 3, so that a high radiation-shielding effect could be obtained.

On the other hand, according to the radiation shielding sheet of Comparative Example 1 which is composed of Pb plate, although the radiation shielding effect is sufficient, the sheet exerts adverse effects on human body and environment.

Further, according to the radiation shielding sheet of Comparative Example 2 which contains W powder, a raw material cost is expensive, thus being not economically efficient. Further, according to the radiation shielding sheet of Comparative Example 3 containing Sn powder, the shielding effect is not sufficient.

Furthermore, as in the radiation shielding sheet of Comparative Example 4, even if cerium oxide ($Ce_2O_3$) powder was contained as the shielding material, but the filling ratio of the shielding material was low, it was confirmed that the shielding effect was decreased.

Further, as in the radiation shielding sheet of Comparative Example 5, when the number of the shielding material grains existing within the straight line segment range L (50 μm) arbitrarily drawn on the radiation shielding sheet was less than 30/A, as shown in FIG. 3, it was confirmed that an amount of radiation 5 leaking through void portions formed between the grains 3, 3 was disadvantageously increased, thus resulting in that a shielding capacity could not be obtained at some portions of the radiation shielding sheet.

INDUSTRIAL APPLICABILITY

As described above, according to the radiation shielding sheet of the present invention, the oxide powder of rare earth element having a safety, a low cost and a high radiation shielding capacity is filled into the organic polymer material, the average grain size of the oxide powder is controlled to be within a predetermined range, and the filling ratio of the shielding material is adjusted to fall within a predetermined range, so that there can be obtained the radiation shielding sheet which is free from any environmental problems and safety problems for a human body, and having a highly radiation shielding performance and excellent economical efficiency.

Figure 1:
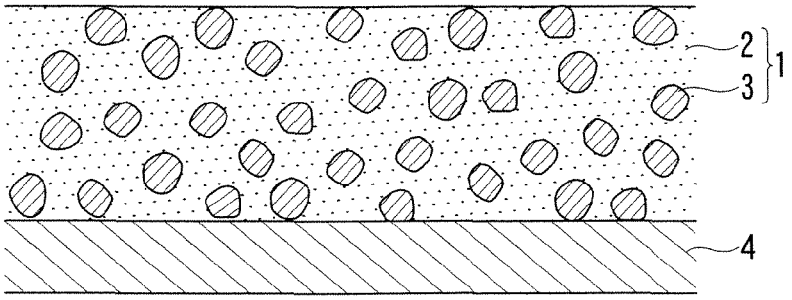
FIG. 1 is a cross sectional view schematically showing a structure of an embodiment of a radiation shielding sheet according to the present invention.
Figure 2:
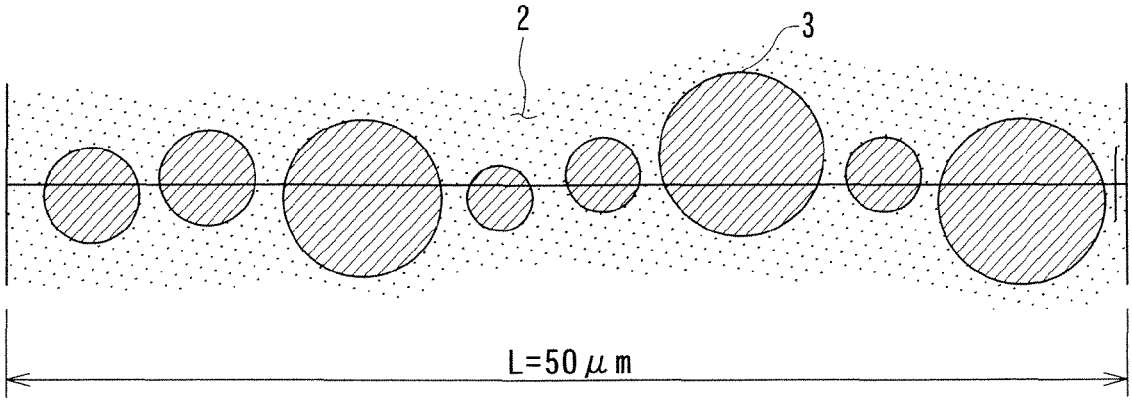
FIG. 2 is a plan view schematically showing a method of counting a number of the shielding material grains existing within a straight line segment range having a predetermined length when the straight line segment range is arbitrarily drawn on a surface of the structure of the radiation shielding sheet.
Figure 3:
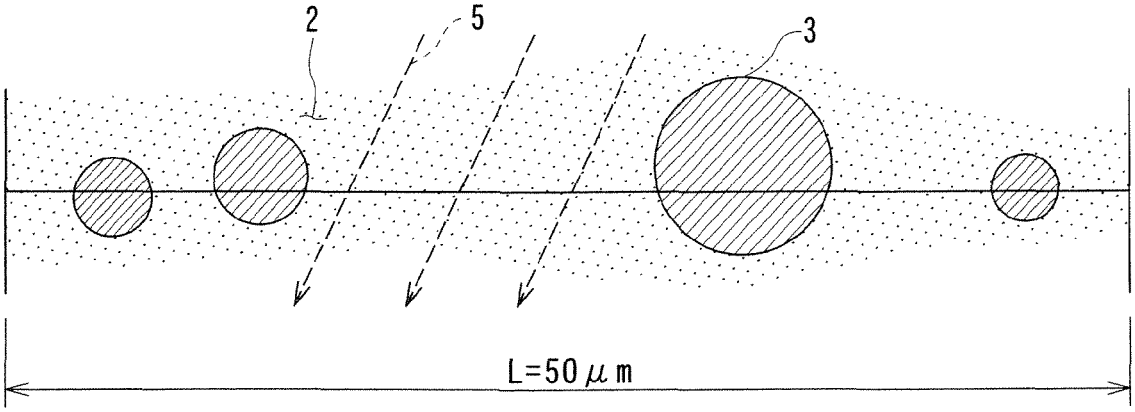
FIG. 3 is another plan view schematically showing a method of counting a number of the shielding material grains existing within a straight line segment range having a predetermined length when the straight line segment range is arbitrarily drawn on a surface of the structure of the radiation shielding sheet.

The invention claimed is:

1. A radiation shielding sheet comprising:

a shielding material mixed with an organic polymer material, wherein said shielding material is an oxide powder containing at least one element selected from the group consisting of lanthanum (La), cerium (Ce), praseodymium (Pr), neodymium (Nd), samarium (Sm), europium (Eu) and gadolinium (Gd), said oxide powder having an average grain size of 1 to 20 μm, and wherein a volumetric ratio of the shielding material in said radiation shielding sheet is 40 to 80 vol. %.

2. A radiation shielding sheet comprising:

an organic polymer material; and a shielding material mixed with said organic polymer material, wherein said shielding material is an oxide powder of a single substance of metal element or metal compound, and has a composition containing lanthanum (La) and cerium (Ce), and wherein the metal compound powder has a composition containing 10 to 40 mass % of lanthanum (La) oxide and 30 to 60 mass % of cerium (Ce) oxide.

3. The radiation shielding sheet according to claim 2, wherein a volumetric ratio of the shielding material filled in said radiation shielding sheet is 40 to 80 vol. %.

4. The radiation shielding sheet according to claim 1, wherein the average grain size of said shielding material grains existing in a structure of the radiation shielding sheet is A μm, where A is no less than 1 μm and no more than 20 μm, such that a quantity of said shielding material grains existing within a straight line segment range having a length of 50 μm is at least equal to 30/A, wherein the straight line segment range is arbitrarily drawn on a surface of the structure of the radiation shielding sheet.

5. The radiation shielding sheet according to claim 1, wherein the organic polymer material is further mixed with at least one powder selected from the group consisting of tungsten (W), bithmus (Bi), tin (Sn) and compounds thereof.

6. The radiation shielding sheet according to claim 1, wherein the radiation shielding sheet is used as a material in a wall of an X-ray room.

7. The radiation shielding sheet according to claim 2, wherein the average grain size of said shielding material grains existing in a structure of the radiation shielding sheet is A μm, where A is no less than 1 μm and no more than 20 μm, such that a quantity of said shielding material grains existing within a straight line segment range having a length of 50 μm is at least equal to 30/A, wherein the straight line segment range is arbitrarily drawn on a surface of the structure of the radiation shielding sheet.

8. The radiation shielding sheet according to claim 2, wherein the organic polymer material is further mixed with at least one powder selected from the group consisting of tungsten (W), bithmus (Bi), tin (Sn) and compounds thereof.

9. The radiation shielding sheet according to claim 2, wherein the radiation shielding sheet is used as a material in a wall of an X-ray room.

10. The radiation shielding sheet according to claim 5, wherein when one of tungsten (W), bithmus (Bi), tin (Sn), or compounds thereof, is included in the radiation shielding material, a weight part ratio of the one of tungsten (W), bithmus (Bi), tin (Sn), or compounds thereof is not greater than 30 weight parts.

11. The radiation shielding sheet according to claim 8, wherein when one of tungsten (W), bithmus (Bi), tin (Sn), or compounds thereof, is included in the radiation shielding material, a weight part ratio of the one of tungsten (W), bithmus (Bi), tin (Sn), or compounds thereof is not greater than 30 weight parts.

12. The radiation shielding sheet according to claim 5, wherein when tin (Sn) is included in the radiation shielding material, a weight part ratio of the tin (Sn) is not greater than 40 weight parts.

13. The radiation shielding sheet according to claim 8, wherein when tin (Sn) is included in the radiation shielding material, a weight part ratio of the tin (Sn) is not greater than 40 weight parts.

* * * * *